US005611737A

United States Patent [19]

Rau et al.

[11] Patent Number: 5,611,737

[45] Date of Patent: Mar. 18, 1997

[54] GOLF TRAINING DEVICE

[76] Inventors: Timothy P. Rau, R.D. #2, Coatesville, Pa. 19320; Galen F. Byler, 2441 Noble Rd., Kirkwood, Pa. 17536

[21] Appl. No.: 496,150

[22] Filed: Jun. 28, 1995

[51] Int. Cl.[6] ..... A63B 57/00

[52] U.S. Cl. ..... 473/137; 473/133

[58] Field of Search ..... 273/201; 473/132, 473/133, 134, 135, 137

[56] References Cited

U.S. PATENT DOCUMENTS

| | | | |
|---|---|---|---|
| 1,598,971 | 9/1926 | Kenyon | 273/201 |
| 1,850,174 | 3/1932 | Joseph | 273/201 |
| 1,888,256 | 11/1932 | Baumgartner | 273/201 |
| 2,013,881 | 9/1935 | Fleming | 273/201 |
| 2,127,282 | 8/1938 | Beckett | 273/201 |
| 2,198,968 | 4/1940 | Jewett | 273/201 |
| 2,450,206 | 9/1948 | Shouse | 273/201 |
| 2,711,321 | 6/1955 | McGraw, Sr. | 273/201 |
| 3,075,774 | 1/1963 | Buell | 273/201 |
| 4,918,054 | 4/1980 | Stone | 273/201 |
| 5,022,657 | 6/1991 | Bussiere et al. | 273/201 |
| 5,322,291 | 6/1994 | Smith et al. | 273/201 |
| 5,356,148 | 10/1994 | Elder, Jr. | 273/201 |
| 5,411,267 | 5/1995 | Burks et al. | 273/201 |

FOREIGN PATENT DOCUMENTS

| | | |
|---|---|---|
| 1167077 | 5/1984 | Canada . |
| 2274788 | 8/1994 | United Kingdom . |

*Primary Examiner*—Steven B. Wong
*Attorney, Agent, or Firm*—Richard C. Litman

[57] ABSTRACT

An automatic human-powered golf training device for use outdoors which can be installed underground and automatically dispenses and tees golf balls. Depressing a foot pedal triggers the gravity-motivated release of an individual ball from a hopper onto a depressed teeing mechanism. Release of the foot pedal causes the depressed teeing mechanism to rise to a desired presentation height. Presentation height is selected by rotating the foot pedal while it is depressed.

19 Claims, 6 Drawing Sheets

GOLF TRAINING DEVICE

BACKGROUND OF THE INVENTION

1. Field of the Invention

The instant invention relates to golf training devices which with minimal effort will repeatedly present a golf ball on a tee at a desired presentation height to a golf player, thereby permitting the player to practice his swing without having to change his stance.

2. Description of the Prior Art

Golf is a sport that emphasizes highly refined and honed skills and which is enjoyed by millions around the world. Because a high degree of refinement of one's stroke is required for successful and competitive play, numerous strategies have been developed to aid in teaching proper movement. Each of these strategies in some manner requires a player to repeat the same movement time and again. For example, a player may simply bring a bucket of golf balls to a driving range and proceed to hit each one, stopping between each shot in order to prepare the next ball. Miniature golf putting practice areas may be installed indoors and require a player to repeatedly putt a ball into a target hole. Miniature golf practice areas have also been designed to allow a player to practice a full swing. Short flight balls have been developed for outdoor use and permit a player to take a full swing without requiring a tremendous hike afterwards in order to retrieve the struck ball. At one technological extreme, sensors may be attached to a player and swing data may be collected for computer emulation and analysis.

Automatic teeing devices present a simple strategy for aiding stroke refinement that allow a player to practice his swing in a manner most closely resembling the swing he will need in competitive play. Typically, several balls are loaded into a hopper and are released individually for positioning on a tee or tee-like device. The method of positioning the balls varies from device to device, but the end result is that a ball is presented to a player on a tee at a particular height repeatedly at the same location. After the player takes his swing a mechanism such as a depressible switch or button is used to signal for the release and positioning of the next ball. By using such a device, a player eliminates the time and effort he would have spent in positioning his balls which gives him more time to spend practicing his swing. Moreover, the player may maintain his stance so that he can find a successful "groove" and preserve the learning experience by committing it to muscle memory. The player also reduces the risk of getting dirty or wet when playing in less than ideal weather.

For example, U.S. Pat. No. 5,356,148, issued to John F. Elder, Jr. on Oct. 18, 1994, demonstrates an automatic below-ground golf ball teeing mechanism in which balls are stored in a hopper until needed. After hitting a ball, a player depresses a button which causes a teeing mechanism contained within a silo to retract downwardly. A trough connects the ball hopper to the silo and gravity is used to cause a ball to load from the trough to the top of the retracted tee. The loaded tee then rises through the cylinder on a pneumatically driven piston. Holding or releasing the button may cause air pressure to be reversed in order to promote the retraction or rising phases of the piston. The height of the piston may be adjusted so that the player may practice different ball situations. The tee must rise from its cylinder on a telescoping section whose extension is limited by a surrounding collar which is secured about the structure with screws. Changing the placement of the collar alters the ultimate tee height.

U.S. Pat. No. 3,075,774, issued to Alvin E. Buell on Jan. 29, 1963, shows a below-ground golf ball teeing device which is human-activated and driven. Balls are stored in a hopper which is connected to a teeing device by an elongated ball raceway. A main shaft which is pivotally attached to a fulcrum is weighted at one end. At the opposite end, the main shaft engages both a golf tee and a second shaft which is pivotally connected to a ball dispensing device. A pedal is connected to the main shaft between a fulcrum and the tee. Depressing the pedal lowers the tee and indirectly triggers the release of a ball from the ball dispensing device so that a single ball is released into the ball raceway. The dispensing device is a disc in which a ball-receiving recess has been cut. The recess can receive one golf ball from the hopper. Depressing the pedal manipulates a series of interconnected shafts to cause the disc to rotate, thereby conveying a ball from the hopper to the raceway. The ball passes from the raceway and comes to rest atop the tee. Depressing the pedal also causes the weight attached to the main shaft to rise. When the pedal is released, gravity acting upon the raised weight causes the main shaft to pivot back to its rest position, thereby raising the tee until the golf ball is at an appropriate height. The height of the ball is controlled by an adjustable stop screw which is interposed between the pedal and the pivot. The stop screw limits the amount by which the main shaft may pivot in reaching the rest position and in so doing, the screw also limits the ultimate height of the tee.

U.S. Pat. No. 2,450,206, issued to James F. Shouse on Sep. 28, 1948, shows a golf ball teeing device for mounting beneath a floor area in which a main shaft is pivotally mounted at one end to the base of the device. A depressible tee is mounted to the opposite end of the shaft and may support a single golf ball and beneath which is a compressible spring. Balls are held in a hopper and are connected to the teeing device by a chute which is large enough to permit balls to roll in single file. When the pedal is depressed, the tee is lowered and spring compressed so that a ball may roll from the chute onto the tee. Releasing the ball permits the spring to expand, thereby raising the tee to its resting position above the floor area. A rod to which the tee is mounded is threaded and engages a threaded socket mounted to the floor area. Rotation of the rod within the socket raises or lowers the pedal height as well as the tee height. The device illustrated in U.S. Pat. No. 1,888,256 issued to Floyd D. Baumgartner on Nov. 22, 1932 works on similar principles, although the device is slightly more complicated. Downward force on a pedal is indirectly communicated to a tee by a lever and piston system. The depressed tee may accept one ball which is raised above the playing surface upon release of the pedal.

U.S. Pat. No. 5,322,291, issued to Ronald T. Smith on Jun. 21, 1994, demonstrates a below-ground golf practice apparatus in which depression of a pedal simultaneously lowers a main shaft which is pivotally connected to a tee and actuates the release of a ball from a dispenser. The released ball rests on the tee which is raised on a riser rod by an air cylinder after the pedal is released. A height adjuster consisting of a bolt and two adjustable nuts is coupled to the main shaft and limits the rise of the ball by limiting the vertical travel of the riser rod.

The below-ground device shown in U.S. Pat. No. 5,022,657, issued to Joseph P. Bussiere et al. on Jun. 11, 1991, functions in a manner similar to that illustrated in the Smith patent. In this device, the main shaft is "L" shaped with a spring and a gas shock connected to the small segment of the "L" and a tee connected to the extreme end of the large segment. Connected to the extreme end of the short segment is a long lever which activates means for releasing a ball from a hopper. A depressible button is connected by a rod to the shaft along the large segment. In this device, a disc having oval shaped holes rotates within the hopper and permits single balls to be released into a feeder chute that terminates in the region wherein the tee is lowered. Depression of the button simultaneously lowers the tee and rotates the ball-releasing disc. The spring connected to the short segment controls the speed with which the gas shock returns the tee to the rest position. Tee height adjustment means consist of a tee adjuster knob which is interposed between the button and the tee and which functions in a manner identical to that of the stop screw found in the Buell device.

U.S. Pat. No. 2,198,968, issued to Josephine F. Jewett on Apr. 30, 1940, shows a below-ground golf teeing device which has a pedal mounted to a rod which is pivotally attached to one end of a main shaft. Beneath the point at which the rod and shaft meet is a compressible spring. The other end of the shaft terminates in a slot which is engaged by a pin attached to a piston. A conical section on which a single ball may rest is mounted to the top of the piston. The piston and conical section reside within a vertically-oriented cylinder which terminates above ground with an elastic tapered portion having a hole in the middle. An arm is pivotally mounted at one end to the outer surface of the cylinder. The other end of the arm is an arcuate prong that is free to rotate about a pivot point located between the two ends of the arm. At the pivot point in the arm, a link is pivotally mounted at one end to the arm and at the other to the main shaft. With the device at rest, a ball may feed from a chute connected to a hopper onto the top of the conical section. Depressing the pedal compresses the spring and causes the main shaft to pivot about its pivot point with the link. As the slotted end of the shaft rises, the engagement of the slot with the pin forces the piston and ball-loaded conical section to rise. As the ball rises, it is extruded through the elastic tapered portion. At the same time, the arcuate prong rotates about the pivot point with the link and comes to rest above the ball seated ont he tapered conical portion, thereby securing the ball. The compressed spring effectuates the return of the piston and pedal to their respective resting points.

U.S. Pat. No. 2,013,881, issued to Walter P. Fleming on Sep. 10, 1935, reveals a below-ground golf teeing apparatus in which the tee is fixed. A main shaft is connected to a depressible pedal by a dowel at one end and to a pair of rods at the other end. One of the two rods supports a ball lifting cup which, in a resting position, may receive one golf ball from a chute leading to a ball hopper. The other rod supports a cup which guides the placement of a ball onto a fixed tee. The shaft is pivotally mounted to a fulcrum located between the two ends. An extendible spring is attached at one end to the top surface of the device and at the other end to the main shaft between the fulcrum and the pedal. Depressing the pedal stretches the spring and at the same time raises the ball lifting cup and the guide cup until they achieve a configuration which permits the ball to be released from the lifting cup into the guide cup and onto the tee. As the spring returns the shaft to the rest position, the two cups retract, leaving the ball positioned on the tee and ready for the next stroke.

United Kingdom Patent No. 2,274,788, issued to Shawki Beidas and published on Sep. 10, 1994; and U.S. Pat. No. 4,198,054, issued to Arthur Stone on Apr. 15, 1980, show other below-ground apparatuses in which the tee remains stationary. In the Beidas patent, a pivoting arm connected to a foot pedal is used to elevate a ball and to deposit it on top of the tee. The apparatus shown in the Stone patent appears in more than one embodiment. In a first embodiment, a pivoting arm collects individual balls and conveys them to the top of the tee. In another embodiment, a piston on a crank receives a golf ball on a tee during a down stroke and presents the ball for hitting on an up stroke.

The devices shown in U.S. Pat. No. 5,411,267, issued to Donald Burks et al. on May 2, 1995; and in Canadian Patent No. 1,167,077, issued to Robert J. Karr on May 8, 1984, are above-ground teeing apparatuses. In the Burks et al. device, balls are stored in a chute-like hopper. A pedal is used to trigger the release of a single ball onto a ramp which leads to the top of a tee. Gravity causes the ball to roll into position. The Karr invention is an electric teeing apparatus in which a feeder arm structure transports balls from a hopper to a tee.

None of the above inventions and patents, taken either singly or in combination, is seen to describe the instant invention as claimed.

SUMMARY OF THE INVENTION

The apparatus of the present invention is a below ground golf training device which can be used by the golf enthusiast to practice repeatedly a particular stroke from a tee at a particular height. A base ties the components of the device together and makes installation into a prepared site a simple matter of inserting the device and securing it. A ball hopper and chute holds balls for individual release into the device. A foot pedal may be depressed to effect ball loading of a tee which rises from the base upon release of the pedal. No power source is used by the device other than human activation. A tiered casing which surrounds a shaft to which the pedal is connected provides a means for altering ball presentation height. A user may readily change the presentation height by rotating the pedal while it is depressed. Once balls are loaded into the hopper, use of the device is completely hands free.

Accordingly, it is a principal object of the invention to provide a golf training device which holds and repetitively presents golf balls on a tee at a designated height. The device is specifically designed to be installed below ground and requires no electricity, propellant or other remote power source for operation.

It is another object of the invention to provide a golf training device in which the operating mechanism consists of a foot actuated system of fulcrums and levers.

It is a further object of the invention to provide a golf training device in which a teeing unit may have more than one repeatably-reproducible presentation heights, wherein a desired presentation height may be selected and set with minimal effort.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
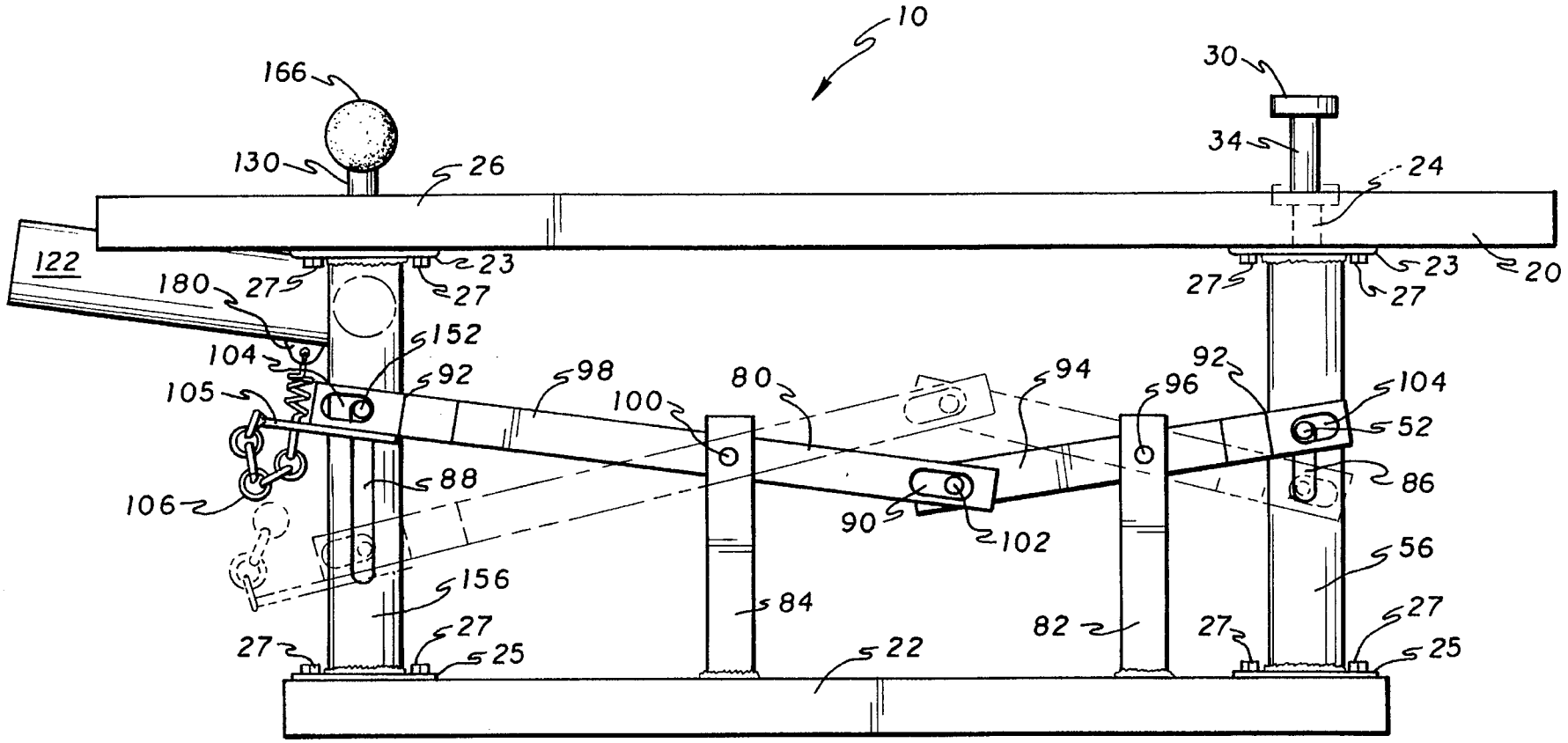
FIG. 1 is an environmental, side elevational view of the invention.

The present invention is a golf training device which may be situated either above ground within a staging or below ground. The device permits a user to hit golf balls repeatedly from a tee at a desired height with minimal effort. Referring to FIGS. 1–11 in greater detail, the golf training device 10 according to the invention includes a substantially flat bottom base 22 and a substantially flat top base 20 in which two circular holes 24, 26 have been cut. A pedal process 60 penetrates the first hole 24 so that a pedal 30 on a rod 34 projects above the top base 20. Similarly, a teeing process 160 penetrates the second hole 26 so that a tee 130 also projects above the top base 20. Referring more particularly to FIG. 2, the configuration of the pedal 30 and the tee 130 can be seen more clearly. The top surface 20 is constructed from a sturdy material such as hardwood or particle board to which a covering has been attached. Acceptable covering material could include indoor-outdoor carpeting or an artificial turf or similar material. A distance of 26" between the two holes 24 and 26 provides a space between the pedal 30 and tee 130 that should allow a comfortable stance for most users of the device.

Figure 3:
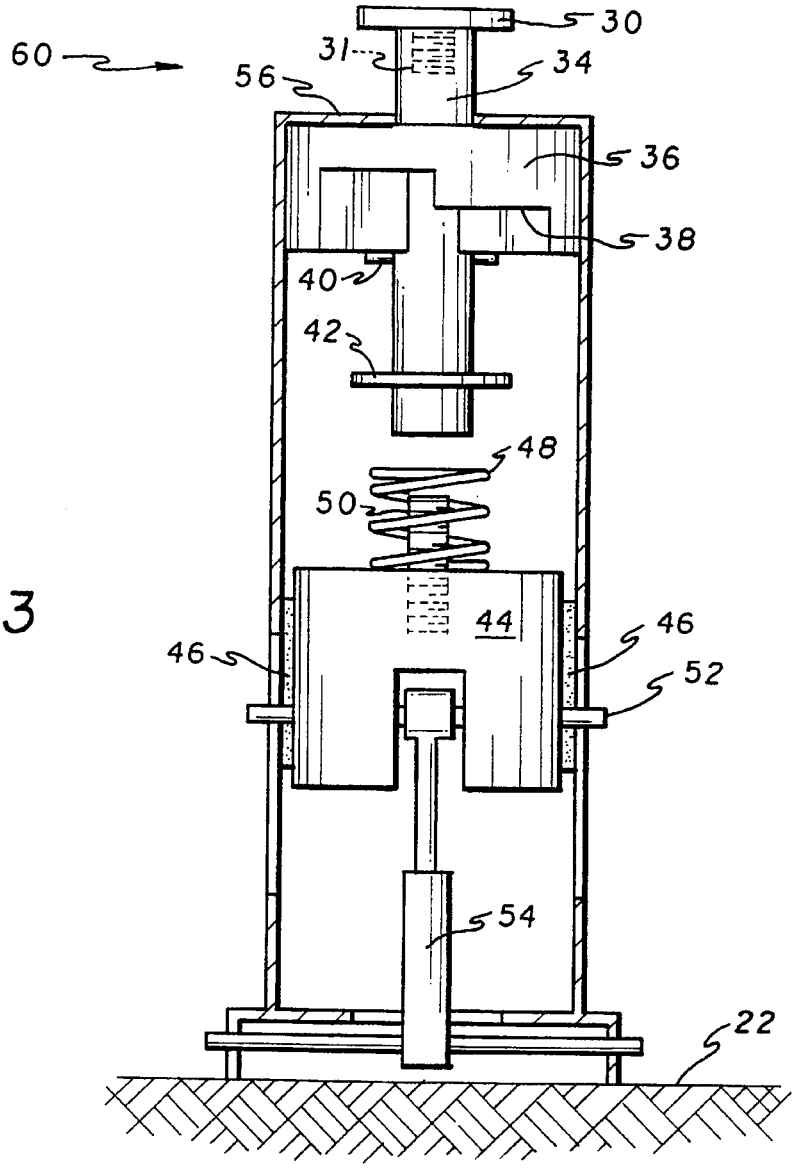
FIG. 3 is an enlarged scale side view of the pedal process of the invention with part of the enclosing first silo removed.
Figure 5:
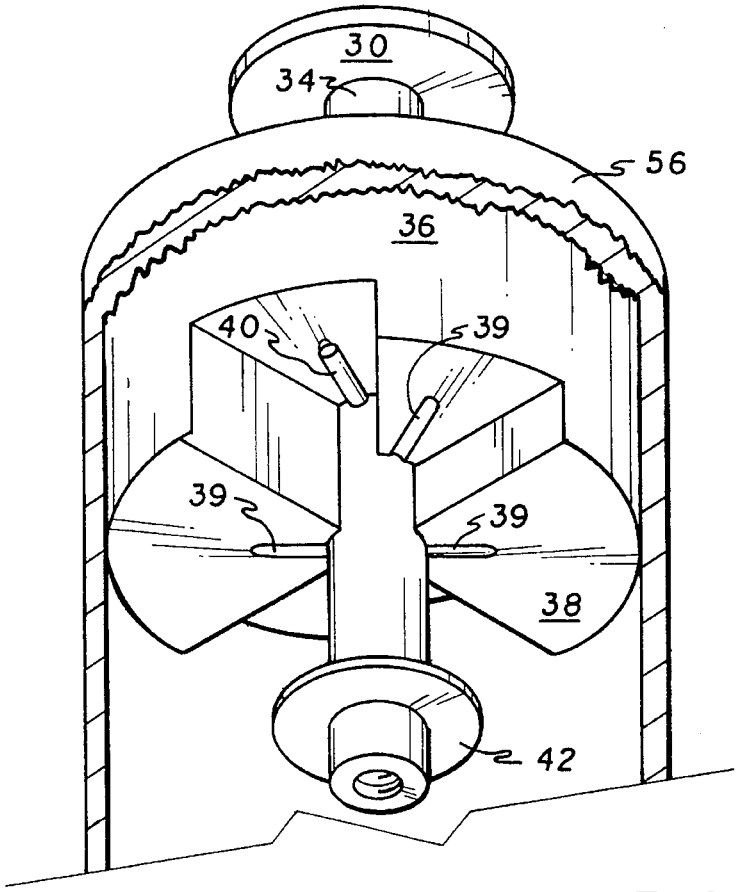
FIG. 5 is a enlarged scale view of the height adjustment means of the invention, parts of the enclosing first silo removed being broken away to reveal interior detail.
Figure 7:
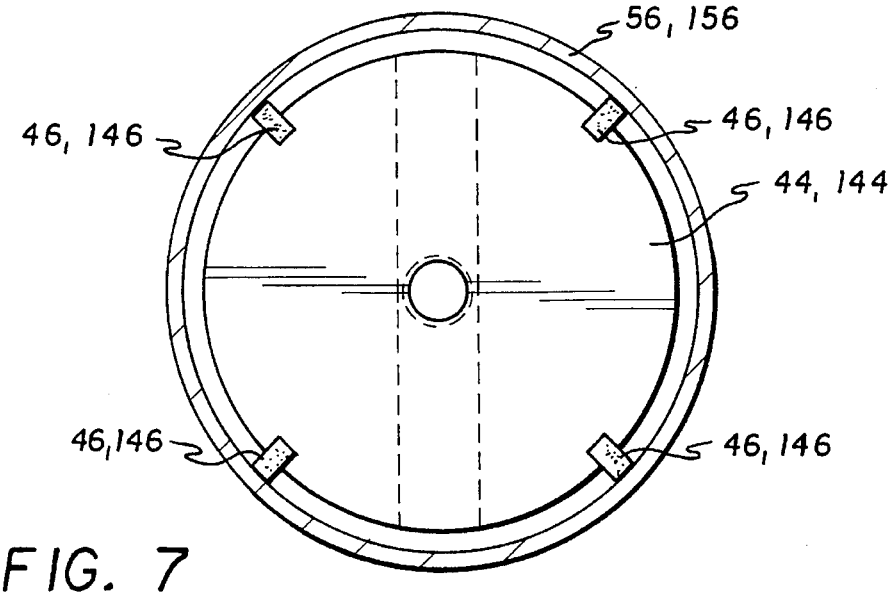
FIG. 7 is an enlarged scale top view of one of the cylindrical pistons of the invention, showing the mediation of contact between the pistons and the silo wall via fins.
Figure 11:
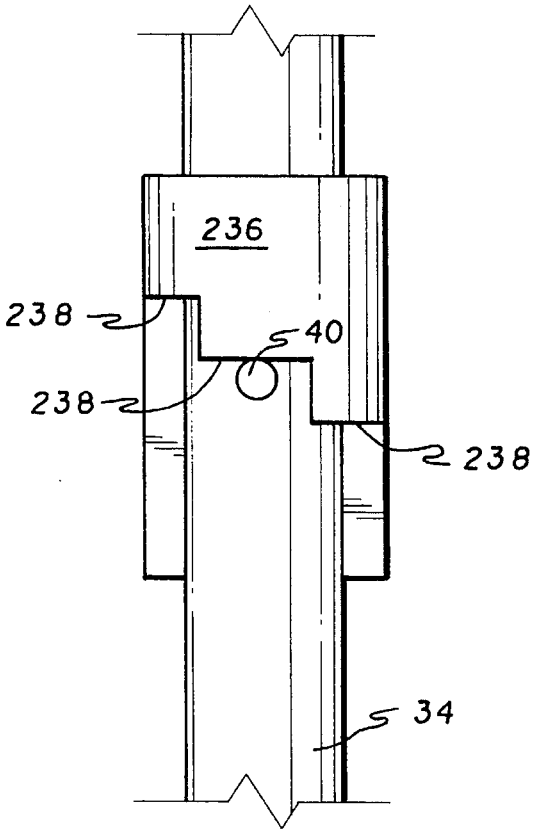
FIG. 11 is an enlarged scale side view of another embodiment of the height adjustment means of the invention.

Referring now to FIGS. 3, 5 and 11 the pedal process 60 is seen in greater detail. The pedal process is housed within a first silo 56. A first flange 23 projects outwardly from the top of the first silo 56 and a second flange 25 projects outwardly from the bottom of the first silo 56. The flanges 23, 25 are attached to the top base 20 and bottom base 22 by a securing means 27 such as screws, bolts or nails. The pedal 30 is fixedly mounted to a rod 34 by such securing means 31 as a nail or screw. The rod 34 is fixedly attached to a washer 42 and is penetrated by a first pin 40 which projects therefrom at a right angle. The rod 34 penetrates a height adjustment means 36, 236 between the pedal 30 and the first pin 40. Beneath the rod 34 within the silo 56 is a compressible spring 48 attached to the top face of a first cylindrical piston 44 and surrounding a stud 50. The compressible spring 48 as shown in FIG. 3 is drawn compressed for illustrative purposes. In practice, the top of the compressible spring 48 contacts the washer 42 and also surrounds the lower end of the rod 34. The stud 50 is centrally embedded in the top face of the first cylindrical piston 44 and provides a guide for the compression of the spring as well as a means to transfer downward pressure applied to the pedal 30 to the first cylindrical piston 44. A first piston pin 52 penetrates the first cylindrical piston 44 and projects therefrom. The base of the first cylindrical piston 44 is cut out in order to accommodate a gas shock 54 which is secured to the bottom of the first silo 56. In use, the pedal process 60 may be seen to move in a strictly vertical fashion within the first silo 56. Pressure applied to the pedal 30 is transmitted through the rod 34 to the stud 50 which presses the first cylindrical piston 44 downward. The gas shock 54 is pressed downwardly and gas within the shock absorbs the compressive force transmitted by the first piston pin 52. As is seen in FIGS. 3 and 7, the cylindrical piston has a diameter slightly smaller than the bore of the first silo 56. Several fins 46 are embedded into the sides of the cylindrical piston and project outwardly to contact the interior surface of the first silo 56. The fins 46 serve to guide the first cylindrical piston 44 in its movement and to minimize the contact surface of the first cylindrical piston 44 with the silo 56. When the pedal 30 is released, re-expansion of the gas in the gas shock 54, drives the pedal process upwards to a rest position projecting outward from said top base.

Figure 4:
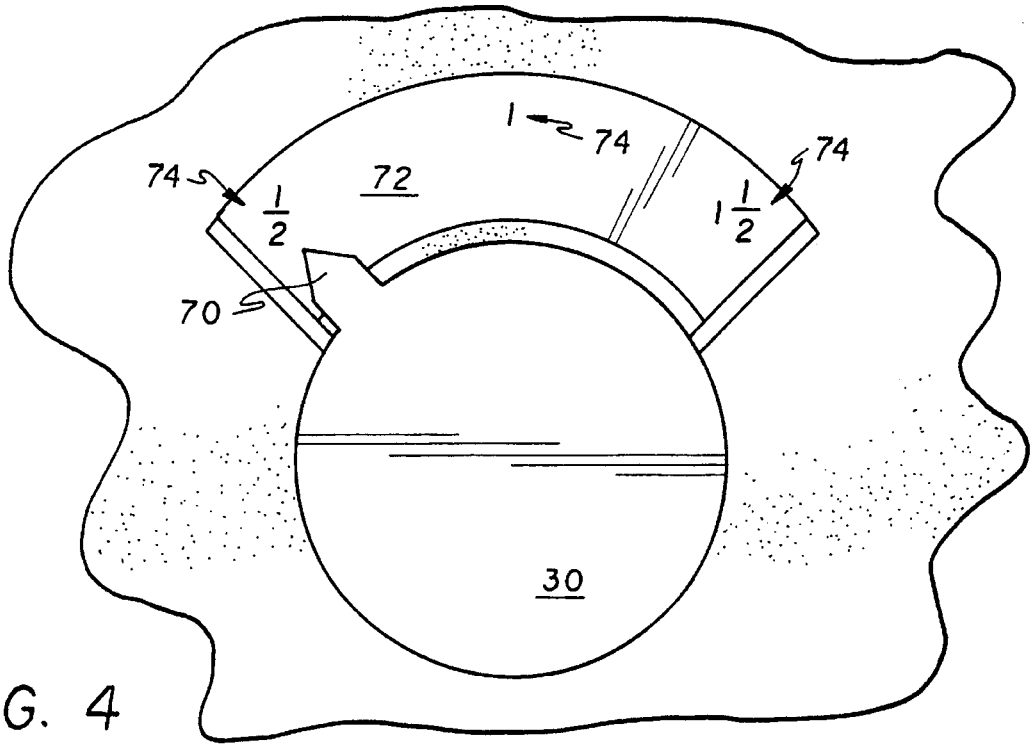
FIG. 4 is a enlarged scale view of the height indicator of the invention.

Referring now to FIG. 5, the height adjustment means 36 is shown to be a disc in which several terraces 3e have been cut and which is fixedly mounted within the first silo 56. As shown, each terrace 38 spans 60°. Three different levels of the terraces 38 have been cut in a consistent order so that opposing terraces are of the same level. The number and size of the terraces 38 is arbitrary and may consist of as many different levels as practicable. In a preferred embodiment, a groove 39 has been cut into each terrace 38. The system of terraces 38 limit the height to which the pedal 30 may rise on the rod 34 above the top surface of the top base 20. The spring 48 applies an upward pressure on the washer 42 which is transmitted to the rod 34 and first pin 40 to ensure snug engagement between the first pin 40 and a pair of terraces 38. The grooves 39 can provide exact centering means for the first pin 40. Referring now to FIG. 11, another embodiment of the height adjustment means 236 is seen to be a cylindrical casing having a long axis, a sidewall, and a top and bottom opening. The cylindrical casing is fixedly mounted within the first silo 56 in which several steps 238 have been cut. Each of the steps 238 may have a groove. Both height adjustment means 36 and 236 function on the same principle of limiting the rise of the pedal 30. When the pedal 30 is depressed, the pin 40 ceases to engage the terraces 38 and the rod 34 may be rotated freely. In this manner, the first pin 40 may be made to engage a different pair of terraces. As a consequence of this rotation, the height to which the pedal 30 rises is altered. Referring now to FIG. 4, a pointer 70 projects outwardly from the pedal 30 and a marked plate 72 is attached to the top surface of the top base 20. The positioning of various markings 74 on the marked plate bears a relationship to the positions of the terraces 38 in the height indicator means such that the pointer 70 will point to a particular marking 74 when the first pin 40 engages a particular pair of terraces 38. As will become apparent, limiting the height of the pedal 30 will limit the presentation height of the tee 130. Altering the height of the pedal 30 similarly alters the presentation height of the tee 130.

Figure 6:
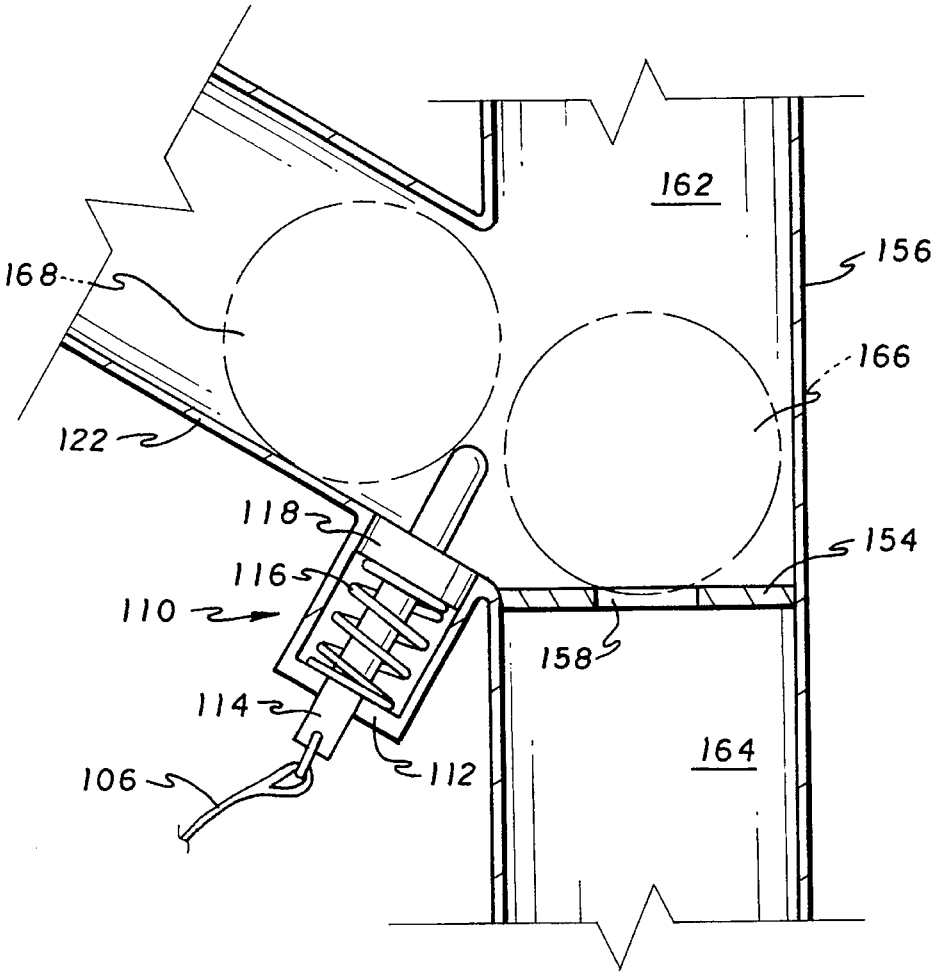
FIG. 6 is a enlarged scale elevational view of the ball restraining means and the ball centering means thereof.
Figure 8:
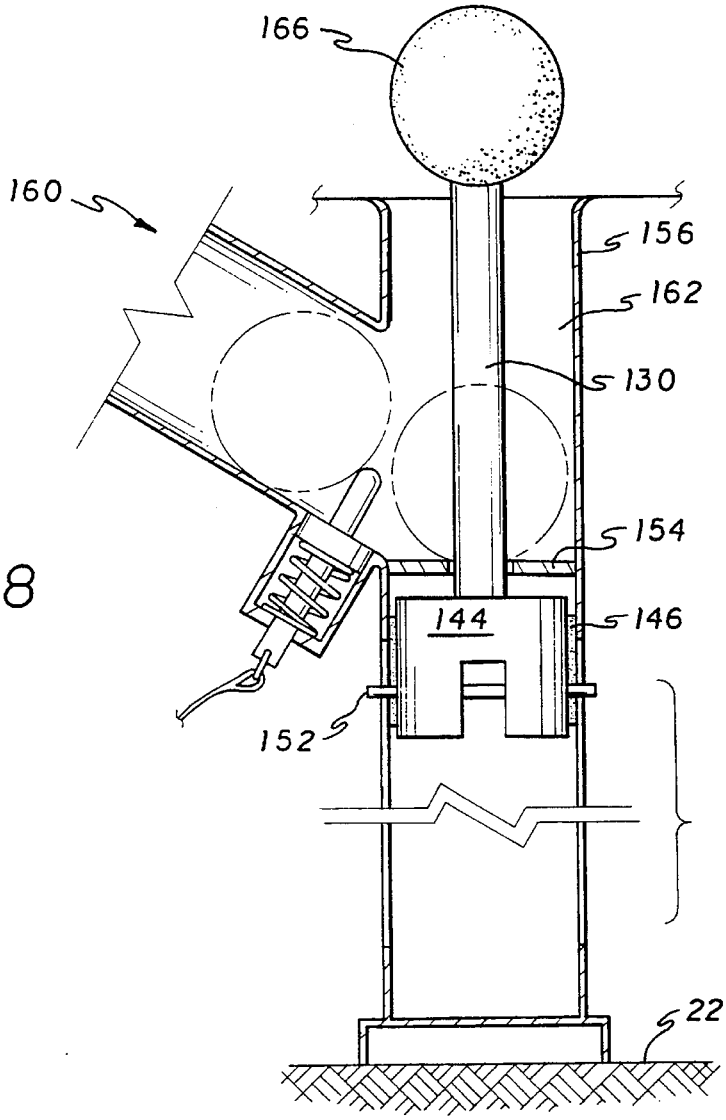
FIG. 8 is an enlarged scale side view of the teeing process with part of the enclosing second silo removed.
Figure 9:
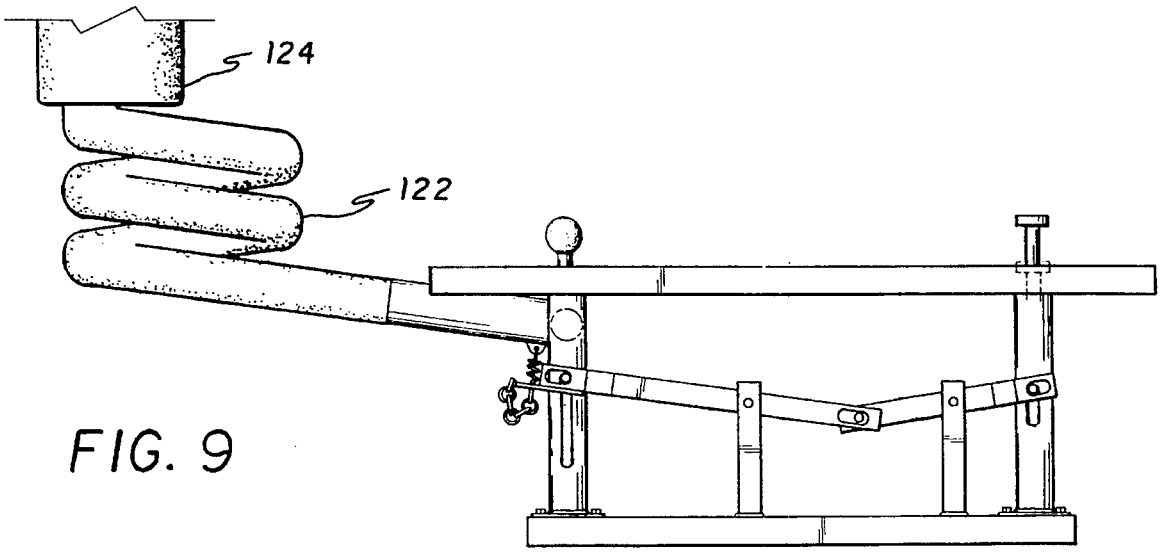
FIG. 9 is a side elevational view similar to FIG. 1, and illustrating the placement of the ball hopper and chute.

Referring now to FIGS. 6, 8 and 9, the teeing process 160 is housed within the second silo 156. As with the first silo 56, a flange 23 projects outwardly from the top and a second flange 25 projects outwardly from the bottom of the second silo 156. Again, the flanges 23, 25 are attached to the top base 20 and bottom base 22 by a securing means 27 such as screws, bolts or nails. A tee or tee-like device 130 is fixedly mounted to a second cylindrical piston 144 which in a fashion like that of the first cylindrical piston 44 contacts the inner wall of the second silo 156 through the mediation of fins 146. The second cylindrical piston 144 is penetrated by a second piston pin 152. The second silo 156 is partitioned into a ball receiving area 162 and a piston housing area 164 by an annular wall 154 having a hole 158 such as a washer. The hole 158 is a ball centering means that guides the correct placement of a ball 166 which has been fed into the ball receiving area 162 onto the top of the tee 130. Balls are stored in a hopper 124 having a chute 122 which is connected to the teeing process 160. The hopper 124 is defined by a bottom wall and a pair of side walls. The bottom wall has a circular hole formed therein such that balls may exit the hopper 124 and enter the chute 122.

Figure 2:
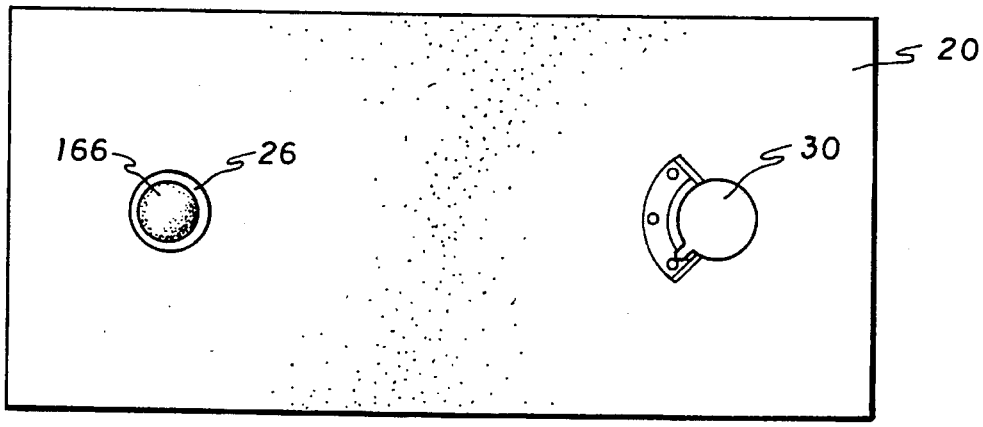
FIG. 2 is a top view thereof, drawn to a reduced scale.
Figure 10:
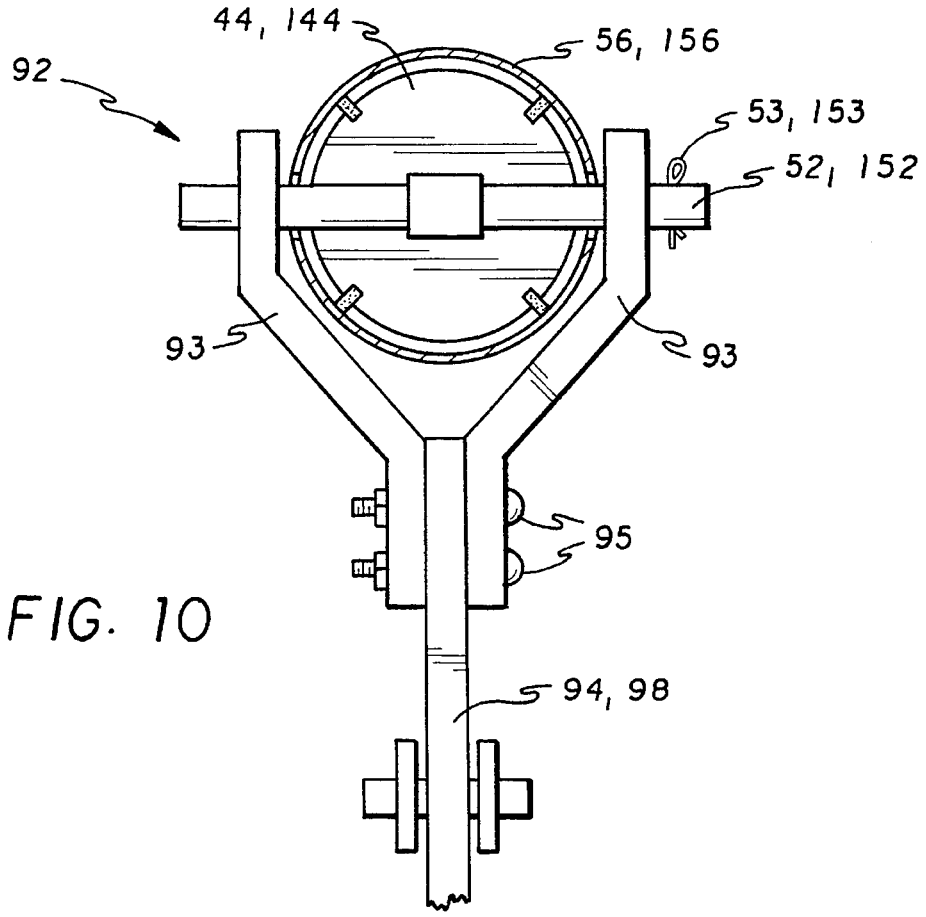
FIG. 10 is an enlarged scale view of the fork assembly of the invention.

Referring to FIG. 1, a lever system 80 is seen to connect the pedal process 60 to the teeing process 160. First and second piston pins 52, 152 project from first and second silos 56, 156 through first and second slots 86, 88, respectively and also through fork assembly slots 104. A first lever 94 having a third lever pin 102 embedded in one end is pivotally mounted by a first lever pin 96 to a first fulcrum 82 which is fixedly attached to the bottom base 22. In likewise manner, a second lever 98 having an elongated slot 90 having rounded ends and two parallel sides is pivotally mounted by a second lever pin 100 to a second fulcrum 84 which is fixedly attached to the bottom base 22. The two levers 94 and 98 are pivotally connected to each other through the slidable engagement between the third lever pin 102 and the elongated slot 90. The two fulcrums 82 and 84 are situated between the first and second silos 56 and 156 along the line joining the silos. Fork assemblies 92 attached to the distal ends of the first and second lever 94 and 98 join the pedal process 60 and teeing process 160 to the lever system 80. Referring now to FIG. 10, the fork assembly 92 is formed by "Z" shaped lateral members 93 which are fixedly attached by nuts and bolts 95 to distal ends of the first and second levers 94, 98. Slots 104 in each of the lateral members engage the piston pins 52 and 152 which are secured by cotter pins 53, 153. A bracket 180 is mounted to one of the lateral members 93 in the fork assembly 92 of the second lever 98. Connecting means 106, such as a linked chain, cable or spring, join the lever system 80 through the bracket 180 to the ball restraining mechanism 110. The restraining mechanism 110 consists of a restraining rod 114 which is biased by a spring 116. One end of the restraining rod 114 projects into the chute 122 through a washer 118 and the opposite end projects through a casing 122 to join the connecting means 106. At rest, the restraining rod 114 prevents balls 168 situated in the chute 122 from entering the ball receiving area 162. In use, downward force applied to the connecting means 106 pulls the restraining rod 114 downward so that it no longer projects into the chute 122, thereby permitting a ball 166 to be centered in the ball receiving area 166 over the hole 158 in the annular wall 154.

It is seen from the above, that downward force applied to the pedal process 60 at the pedal 30 is transmitted through the lever system 80 to depress the teeing process 160 and to activate the ball releasing mechanism 110. Balls are released from the chute individually into the ball receiving area 166 to be centered onto the depressed tee 130. Release of the pedal 30 allows the restoring force of the gas shock 54 to drive the pedal process 60 upwards, simultaneously driving the teeing process 160 upward and returning the ball restraining mechanism 110 to rest. In returning to its resting position, the teeing process 160 presents a golf ball to the waiting golf enthusiast at a predetermined height. As can now be clearly seen, a limitation on the vertical rise of the pedal process 60 imparts a limitation in the vertical rise of the teeing process 160 by virtue of the arrangement of the lever system 80.

Once balls are loaded into the hopper 124, the golf player may operate the golf training device 10 in a completely hands free manner. For illustrative purposes only and not as means of limitation, suggested materials of construction for the general outlines of the device include stainless steel for the bottom base, 22, first and second silos 56, 156 and flanges 23, 25; aluminum for the cylindrical pistons 44, 144 and the lever system 80; and fiberglass for the fins 46, 146. The circular holes 24 and 26 cut into the top base 20 may be threaded to accommodate threaded waterproof caps which are not herein illustrated or claimed. However, it is anticipated that due to the outdoors characteristic of golfing, should be weather resistant and preferably protected by such weather proof devices as said caps.

It is to be understood that the present invention is not limited to the embodiments described above, but encompasses any and all embodiments within the scope of the following claims.

We claim:

1. A golf training device comprising:

a substantially flat rectangular bottom base;

a substantially flat rectangular top base having a first circular opening, a second circular opening and a top surface;

a golf ball hopper having a plurality of sides and a bottom and a circular hole formed in said bottom of said golf ball hopper, a chute having a circular cross section and an interior and connected to said golf ball hopper at said circular hole;

a compressible ball restraining mechanism fixedly mounted within said chute, said compressible ball restraining mechanism including a casing fixedly mounted in and projecting into said chute, a compressible spring loaded restraining rod fixedly attached within said casing having a bottom and a top, said top of said restraining rod projecting into said interior of said chute a linking means connecting said bottom of said compressible spring loaded restraining rod to one of said levers of said lever system;

a first silo having a first piston pin projecting therefrom and a second silo having a second piston pin projecting therefrom, each silo being hollow and each having a wall, a top end, a bottom end and a pair of narrow slots cut into said wall for receiving said first piston pin and said second piston pin, respectively, said first silo penetrating said first circular opening in said top base and said second silo penetrating said second circular opening in said top base;

an attachment means for fixedly mounting said first and second silos to said top and bottom bases;

a depressible pedal process having a rod, said rod having a pedal fixedly mounted thereto, said pedal projecting outward from said top base, said depressible pedal process being movable between a first position when said depressible pedal process is at rest and a second position when said depressible pedal process is depressed, said depressible pedal process being housed within said first silo;

means for moving said depressible pedal process from said second position to said first position;

a height adjustment means through which said rod penetrates and which is housed within said first silo;

a tee fixedly mounted to a depressible teeing process which is housed within said second silo and which is movable between a first position and second position, said first position being relatively higher than said second position, whereby when said depressible teeing process is moved to said second position, said tee may receive a golf ball released from said chute by said compressible ball restraining device;

a ball centering means; and a lever system having a plurality of levers and a plurality of fulcrums connecting said pedal process to said depressible teeing process and connected to said compressible ball restraining device.

2. The golf training device according to claim 1, wherein said rod of said depressible pedal process further includes a pedal pin, said pedal process being penetrated by said pedal pin which projects from said rod at a right angle.

3. The golf training device according to claim 2, wherein said height adjustment means comprises a cylindrical casing having a long axis, a sidewall, a top opening and a bottom opening, said cylindrical casing being fixedly mounted within said first silo and having a plurality of steps cut into said sidewall along said long axis, said pedal pin of said rod of said depressible pedal process engaging said plurality of steps.

4. The golf training device according to claim 3, further comprising a height indicator mounted to said top surface of said substantially flat rectangular top base.

5. The golf training device according to claim 4, wherein said height indicator comprises a pointer projecting from said pedal and a marked plate having a plurality of indications of calibration and being fixedly attached to said top surface of said top base about said first circular opening, whereby said pointer points to only one of said indications when one of said steps is engaged by said pedal pin.

6. The golf training device according to claim 5, wherein each of said steps cut into said sidewall of said cylindrical casing has a groove.

7. The golf training device according to claim 2, wherein said height adjustment means comprises a disc having a plurality of terraces which engage said pedal pin.

8. The golf training device according to claim 7, further comprising a height indicator mounted to said top surface of said substantially flat rectangular top base.

9. The golf training device according to claim 8, wherein said height indicator comprises a pointer projecting from said pedal and a marked plate having a plurality of indications of calibration and being fixedly attached to said top surface of said top base about said first circular opening, whereby said pointer points to only one of said indications when one of said terraces is engaged by said pedal pin.

10. The golf training device according to claim 9, wherein each of said terraces in said disc has a groove.

11. The golf training device according to claim 1, wherein said ball centering means is a washer.

12. A golf training device comprising:

a substantially flat rectangular bottom base;

a substantially flat rectangular top base having a first circular opening, second circular opening and a top surface;

a golf ball hopper having a plurality of sides and a bottom and a circular hole in said bottom of said golf ball hopper;

a chute having a circular cross section and an interior and connected to said golf ball hopper at said circular hole;

a compressible ball restraining mechanism fixedly mounted within said chute;

a first silo and a second silo, each being hollow and each having a wall, a top end, a bottom end and a pair of narrow slots cut into said wall, said first silo penetrating said first circular opening in said top base and said second silo penetrating said second circular opening in said top base;

an attachment means for fixedly mounting said first and second silos to said top and bottom bases;

a height indicator mounted to said top surface of said substantially flat rectangular top base;

a depressible pedal process which is housed within said first silo and including:

a pedal fixedly mounted to a first end of a first rod, said first rod with a first pin, said first rod being penetrated by said first pin which projects from said first rod at a right angle;

a height adjustment means through which said first rod penetrates and with which said first pin engages;

a first cylindrical piston having a top surface, a bottom surface and a sidewall, said first cylindrical piston being movable between a first position when said depressible pedal process is at rest and a second position when said depressible pedal process is depressed;

a plurality of fins projecting from said sidewall of said first cylindrical piston;

a second pin which penetrates said first cylindrical piston and which engages said pair of narrow slots in said wall of said first silo;

means for moving said first cylindrical piston from said second position to said first position;

a compressible means fixedly attached to said top surface of said first cylindrical piston and abutting a second end of said first rod;

a depressible teeing process which is housed within said second silo, and has a second rod, said depressible teeing process including:

a tee mounted to said second rod;

a second cylindrical piston movable between a first position when said depressible teeing process is at rest and a second position when said depressible teeing process is depressed;

a plurality of fins projecting from said sidewall of said second cylindrical piston;

a third pin which penetrates said second cylindrical piston and which engages said pair of narrow slots in said wall of said second silo;

a ball centering means and;

a lever system having a plurality of levers and a plurality of fulcrums connecting said pedal process to said depressible teeing process and connected to said compressible ball restraining device.

13. The golf training device according to claim 12, wherein said means for moving said first cylindrical piston from said second position to said first position is a gas shock.

14. The golf training device according to claim 13, wherein said compressible ball restraining mechanism fixedly mounted within said chute includes:

a casing fixedly mounted in and projecting into said chute;

a compressible spring loaded restraining rod fixedly attached within said casing having a bottom and a top, said top of said restraining rod projecting into said interior of said chute;

a linking means connecting said bottom of said compressible spring loaded restraining rod to one of said levers of said lever system, whereby tension applied to said bottom effects compression of said compressible spring loaded restraining rod.

15. The golf training device according to claim 14, wherein said height adjustment means comprises a cylindrical casing having a long axis, a sidewall, a top opening and a bottom opening, said cylindrical casing being fixedly mounted within said first silo and having a plurality of steps cut into said sidewall along said long axis, said first pin of said rod of said depressible pedal process engaging said plurality of steps.

16. The golf training device according to claim 15, further comprising a height indicator mounted to said top surface of said substantially flat rectangular top base.

17. The golf training device according to claim 16, wherein said height indicator consists of a pointer projecting from said pedal and a marked plate having a plurality of indications of calibration and being fixedly attached to said top surface of said top base about said first circular opening, whereby said pointer points to only one of said indications when one of said steps is engaged by said first pin.

18. The golf training device according to claim 17, wherein each of said steps cut into said sidewall of said cylindrical casing has a groove.

19. The golf training device according to claim 18, wherein said ball centering means is a washer.

* * * * *